US006100911A

United States Patent [19]

Kerr

[11] Patent Number: 6,100,911

[45] Date of Patent: Aug. 8, 2000

[54] METHOD AND APPARATUS TO PROVIDE A LOADING FORCE PRINT-HEAD ADJUSTMENT USING MAGNETS

[75] Inventor: Roger S. Kerr, Brockport, N.Y.

[73] Assignee: Eastman Kodak Company, Rochester, N.Y.

[21] Appl. No.: 09/143,007

[22] Filed: Aug. 28, 1998

[51] Int. Cl.[7] ..... B41J 2/435

[52] U.S. Cl. ..... 347/224

[58] Field of Search ..... 400/120.16, 120.17; 347/197, 198, 241, 242, 245, 256, 257, 263, 264, 224; 346/139 R

[56] References Cited

U.S. PATENT DOCUMENTS

| | | | |
|---|---|---|---|
| 3,934,950 | 1/1976 | Kuhlmann | 310/905 |
| 4,445,060 | 4/1984 | Ruhle et al. | 310/154 |
| 4,473,259 | 9/1984 | Goldowsky | 310/90.5 |
| 4,647,891 | 3/1987 | Hughes | 335/302 |
| 4,683,476 | 7/1987 | Ferrari et al. | 346/29 |
| 4,857,873 | 8/1989 | Gillings | 335/285 |
| 4,863,240 | 9/1989 | Nakajima et al. | 359/814 |
| 4,992,768 | 2/1991 | Mozis et al. | 335/306 |
| 5,017,819 | 5/1991 | Patt et al. | 310/90.5 |
| 5,038,063 | 8/1991 | Graber et al. | 310/115 |
| 5,148,066 | 9/1992 | Beale et al. | 310/17 |
| 5,213,251 | 5/1993 | Wolff | 228/199 |
| 5,268,708 | 12/1993 | Harshbarger et al. | 346/134 |
| 5,407,283 | 4/1995 | Ohtsuka et al. | 384/130 |
| 5,700,140 | 12/1997 | Gray et al. | 418/104 |
| 5,715,600 | 2/1998 | Marriott et al. | 29/898.07 |
| 5,729,066 | 3/1998 | Soong et al. | 310/90.5 |

*Primary Examiner*—N. Le
*Assistant Examiner*—Michael Nghiem
*Attorney, Agent, or Firm*—David A. Novais; Nelson Adrian Blish

[57] ABSTRACT

An image processing apparatus for sheet thermal print media includes a vacuum imaging drum for holding thermal print media and dye donor material in registration on the vacuum imaging drum. A print-head moves along a line parallel to a longitudinal axis of the vacuum imaging drum as the vacuum imaging drum rotates. The print-head receives information signals and produces radiation which is directed to the dye donor material which causes color to transfer from the dye donor material to the thermal print media. Focus adjustment of the print-head employs magnetic loading force against an adjustment device, using a combination of permanent magnets that provide magnetic attraction and repulsion. Also, print-head angle adjustment uses a further combination of permanent magnets that provide a magnetic loading force against a further adjustment device using magnetic attraction and repulsion.

9 Claims, 7 Drawing Sheets

METHOD AND APPARATUS TO PROVIDE A LOADING FORCE PRINT-HEAD ADJUSTMENT USING MAGNETS

CROSS REFERENCE TO RELATED APPLICATIONS

The present application is related to co-pending U.S. patent application Ser. No. 09/143,007, filed Aug. 28, 1998, by Roger S. Kerr, entitled A MAGNETIC ARRANGEMENT FOR PRINTHEAD POSITIONING IN AN IMAGE PROCESSING APPARATUS.

FIELD OF THE INVENTION

The present invention relates to a print-head subsystem of an image processing apparatus of a lathe bed scanning type, where a loading force is applied against an adjustment device to effect precise print-head focus and angular adjustment.

BACKGROUND OF THE INVENTION

Pre-press color proofing is a procedure that is used by the printing industry for creating representative images of printed material, without the high cost and time that is required to actually produce printing plates and set up a high-speed, high-volume, printing press to produce a single example of an intended image. These intended images may require several corrections and may need to be reproduced several times to satisfy the requirements of customers, resulting in a large loss of profits. By utilizing pre-press color proofing time and money can be saved.

One such commercially available image processing apparatus, which is depicted in commonly assigned U.S. Pat. No. 5,268,708 is an image processing apparatus having half-tone color proofing capabilities. This image processing apparatus is arranged to form an intended image on a sheet of thermal print media by transferring dye from a sheet of dye donor material to the thermal print media by applying a sufficient amount of thermal energy to the dye donor material to form an intended image. This image processing apparatus is comprised generally of a material supply assembly or carousel, lathe bed scanning subsystem (which includes a lathe bed scanning frame, a translation drive, a translation stage member, a print-head, and a vacuum imaging drum), and thermal print media and dye donor material exit transports.

The operation of the above image processing apparatus comprises metering a length of the thermal print media (in roll form) from the material assembly or carousel. The thermal print media is then measured and cut into sheet form of the required length, transported to the vacuum imaging drum, registered, wrapped around and secured onto the vacuum imaging drum. Next a length of dye donor material (in roll form) is also metered out of the material supply assembly or carousel, then measured and cut into sheet form of the required length. It is then transported to and wrapped around the vacuum imaging drum, such that it is superposed in the desired registration with respect to the thermal print media (which has already been secured to the vacuum imaging drum).

After the dye donor material is secured to the periphery of the vacuum imaging drum, the scanning subsystem or write engine provides the scanning function. This is accomplished by retaining the thermal print media and the dye donor material on the spinning vacuum imaging drum while it is rotated past the print-head that will expose the thermal print media. The translation drive then traverses the print-head and translation stage member axially along the vacuum imaging drum, in coordinated motion with the rotating vacuum imaging drum. These movements combine to produce the intended image on the thermal print media.

After the intended image has been written on the thermal print media, the dye donor material is then removed from the vacuum imaging drum. This is done without disturbing the thermal print media that is beneath it. The dye donor material is then transported out of the image processing apparatus by the dye donor material exit transport. Additional dye donor materials are sequentially superposed with the thermal print media on the vacuum imaging drum, then imaged onto the thermal print media as previously mentioned, until the intended image is completed. The completed image on the thermal print media is then unloaded from the vacuum imaging drum and transported to an external holding tray on the image processing apparatus by the receiver sheet material exit transport.

The material supply assembly comprises a carousel assembly mounted for rotation about its horizontal axis on bearings at the upper ends of vertical supports. The carousel comprises a vertical circular plate having in this case six (but not limited to six) material support spindles. These support spindles are arranged to carry one roll of thermal print media, and four rolls of dye donor material to provide the four primary colors used in the writing process to form the intended image, and one roll as a spare or for a specialty color dye donor material (if so desired). Each spindle has a feeder assembly to withdraw the thermal print media or dye donor material from the spindles to be cut into a sheet form. The carousel is rotated about its axis into the desired position, so that the thermal print media or dye donor material (in roll form) can be withdrawn, measured, and cut into sheet form of the required length, and then transported to the vacuum imaging drum.

The scanning subsystem or write engine of the lathe bed scanning type comprises a mechanism that provides the mechanical actuators, for the vacuum imaging drum positioning and motion control to facilitate placement, loading onto, and removal of the thermal print media and the dye donor material from the vacuum imaging drum. The scanning subsystem or write engine provides the scanning function by retaining the thermal print media and dye donor material on the rotating vacuum imaging drum, which generates a once per revolution timing signal to the data path electronics as a clock signal; while the translation drive traverses the translation stage member and print-head axially along the vacuum imaging drum in a coordinated motion with the vacuum imaging drum rotating past the print-head. This is done with positional accuracy maintained, to allow precise control of the placement of each pixel, in order to produce the intended image on the thermal print media.

The lathe bed scanning frame provides the structure to support the vacuum imaging drum and its rotational drive. The translation drive with a translation stage member and print-head are supported by two translation bearing rods that are substantially straight along their longitudinal axis and are positioned parallel to the vacuum imaging drum and lead screw. Consequently, they are parallel to each other therein forming a plane, along with the vacuum imaging drum and lead screw. The translation bearing rods are, in turn, supported by outside walls of the lathe bed scanning frame of the lathe bed scanning subsystem or write engine. The translation bearing rods are positioned and aligned therebetween, for permitting low friction movement of the translation stage member and the translation drive. The translation bearing rods are sufficiently rigid for this application, so as not to sag or distort between the mounting points at their ends. They are arranged to be as exactly parallel as is possible with the axis of the vacuum imaging drum. The front translation bearing rod is arranged to locate the axis of the print-head precisely on the axis of the vacuum imaging drum with the axis of the print-head located perpendicular, vertical, and horizontal to the axis of the vacuum imaging drum. The translation stage member front bearing is arranged to form an inverted "V" and provides only that constraint to the translation stage member. The translation stage member with the print-head mounted on the translation stage member, is held in place by only its own weight. The rear translation bearing rod locates the translation stage member with respect to rotation of the translation stage member about the axis of the front translation bearing rod. This is done so as to provide no over constraint of the translation stage member which might cause it to bind, chatter, or otherwise impart undesirable vibration or jitters to the translation drive or print-head during the writing process causing unacceptable artifacts in the intended image. This is accomplished by the rear bearing which engages the rear translation bearing rod only on a diametrically opposite side of the translation bearing rod on a line perpendicular to a line connecting the centerlines of the front and rear translation bearing rods.

The translation drive is for permitting relative movement of the print-head by synchronizing the motion of the print-head and stage assembly such that the required movement is made smoothly and evenly throughout each rotation of the drum. A clock signal generated by a drum encoder provides the necessary reference signal accurately indicating the position of the drum. This coordinated motion results in the print-head tracing out a helical pattern around the periphery of the drum. The above mentioned motion is accomplished by means of a DC servo motor and encoder which rotates a lead screw that is typically, aligned parallel with the axis of the vacuum imaging drum. The print-head is placed on the translation stage member in a "V" shaped groove, which is formed in the translation stage member, which is in precise positional relationship to the bearings for the front translation stage member supported by the front and rear translation bearing rods. The translation bearing rods are positioned parallel to the vacuum imaging drum, so that it automatically adopts the preferred orientation with respect to the surface of the vacuum imaging drum.

The print-head is selectively locatable with respect to the translation stage member, thus it is positioned with respect to the vacuum imaging drum surface. The distance between the print-head and the vacuum imaging drum surface is adjustable for focus. Extension springs provide the load against the adjustment screws for this focus adjustment. The angle of the print-head is also adjustable by rotating the cylindrical lens body. Here also, extension springs provide the load against the adjustment screw.

The translation stage member and print-head are attached to a rotatable lead screw (having a threaded shaft) by a drive nut and coupling. The coupling is arranged to accommodate misalignment of the drive nut and lead screw so that only rotational forces and forces parallel to the lead screw are imparted to the translation stage member by the lead screw and drive nut. The lead screw rests between two sides of the lathe bed scanning frame of the lathe bed scanning subsystem or write engine, where it is supported by deep groove radial bearings. At the drive end the lead screw continues through the deep groove radial bearing, through a pair of spring retainers, that are separated and loaded by a compression spring to provide axial loading, and to a DC servo drive motor and encoder. The DC servo drive motor induces rotation to the lead screw moving the translation stage member and print-head along the threaded shaft as the lead screw is rotated. The lateral directional movement of the print-head is controlled by switching the direction of rotation of the DC servo drive motor and thus the lead screw.

The print-head includes a plurality of laser diodes which are coupled to the print-head by fiber optic cables which can be individually modulated to supply energy to selected areas of the thermal print media in accordance with an information signal. The print-head of the image processing apparatus includes a plurality of optical fibers coupled to the laser diodes at one end and the other end to a fiber optic array within the print-head. The print-head is movable relative to the longitudinal axis of the vacuum imaging drum. The dye is transferred to the thermal print media as the radiation, transferred from the laser diodes by the optical fibers to the print-head and thus to the dye donor material is converted to thermal energy in the dye donor material.

The vacuum imaging drum is cylindrical in shape and includes a hollowed-out interior portion. The vacuum imaging drum further includes a plurality of holes extending through its housing for permitting a vacuum to be applied from the interior of the vacuum imaging drum for supporting and maintaining the position of the thermal print media and dye donor material as the vacuum imaging drum rotates. The ends of the vacuum imaging drum are enclosed by cylindrical end plates. The cylindrical end plates are each provided with a centrally disposed spindle which extends outwardly through support bearings and are supported by the lathe bed scanning frame. One of the spindles is a drive end spindle that extends through the support bearing and is stepped down to receive a DC drive motor rotor which is held on by means of a nut. A DC motor stator is stationarily held by the lathe bed scanning frame member, encircling the armature to form a reversible, variable speed DC drive motor for the vacuum imaging drum. At the end of the spindle an encoder is mounted to provide the timing signals to the image processing apparatus. The opposite spindle is a vacuum spindle and is provided with a central vacuum opening, which is in alignment with a vacuum fitting with an external flange that is rigidly mounted to the lathe bed scanning frame. The vacuum fitting has an extension which extends within but is closely spaced from the vacuum spindle, thus forming a small clearance. With this configuration, a slight vacuum leak is provided between the outer diameter of the vacuum fitting and the inner diameter of the opening of the vacuum spindle. This assures that no contact exists between the vacuum fitting and the vacuum imaging drum which might impart uneven movement or jitters to the vacuum imaging drum during its rotation.

The opposite end of the vacuum fitting is connected to a high-volume vacuum blower which is capable of producing 50–60 inches of water (93.5–112.2 mm of mercury) at an air flow volume of 60–70 cfm (28.368–33.096 liters per second). This provides the vacuum to the vacuum imaging drum to support the various internal vacuum levels of the vacuum imaging drum required during the loading, scanning and unloading of the thermal print media and the dye donor materials to create the intended image. With no media loaded on the vacuum imaging drum the internal vacuum level of the vacuum imaging drum is approximately 10–15 inches of water (18.7–28.05 mm of mercury). With just the thermal print media loaded on the vacuum imaging drum the internal vacuum level of the vacuum imaging drum is approximately 20–25 inches of water (37.4–46.75 mm of mercury); this is the level required when a dye donor material is removed so that thermal print media does not move, otherwise color to color registration will not be maintained. With both the thermal print media and dye donor material completely loaded on the vacuum imaging drum the internal vacuum level of the vacuum imaging drum is approximately 50–60 inches of water (93.5–112.2 mm of mercury) in this configuration.

The outer surface of the vacuum imaging drum is provided with an axially extending flat, which extends approximately 8 degrees of the vacuum imaging drum circumference. The vacuum imaging drum is also provided with a circumferential recess which extends circumferentially from one side of the axially extending flat, circumferentially around the vacuum imaging drum to the other side of the axially extending flat, and from approximately one inch (25.4 mm) from one end to approximately one inch (25.4 mm) from the other end of the vacuum imaging drum. The thermal print media when mounted on the vacuum imaging drum is seated in the circumferential recess and therefor the circumferential recess has a depth substantially equal to the thermal print media thickness seated therewithin, which is approximately 0.004 inches (0.102 mm) in thickness.

The purpose of the circumferential recess on the vacuum imaging drum surface is to eliminate any creases in the dye donor materials, as they are drawn down over the thermal print media during the loading of the dye donor materials. This assures that no folds or creases will be generated in the dye donor materials which could extend into the image area and seriously adversely affect the intended image. The circumferential recess also substantially eliminates the entrapment of air along the edge of the thermal print media, where it is difficult for the vacuum holes in the vacuum imaging drum surface to assure the removal of the entrapped air. Any residual air between the thermal print media and the dye donor material, can also adversely affect the intended image.

The purpose of the vacuum imaging drum axially extending flat is two-fold. First, it assures that the leading and trailing ends of the dye donor material are somewhat protected from the effect of air turbulence during the relatively high speed rotation that the vacuum imaging drum undergoes during the imaging process. Thus the air turbulence would have less tendency to lift the leading or trailing edges of the dye donor material. Second, the vacuum imaging drum axially extending flat also ensures that the leading and trailing ends of the dye donor material are recessed from the vacuum imaging drum periphery. This reduces the chance that the dye donor material can come in contact with other parts of the image processing apparatus, such as the print-head, causing a jam and possible loss of the intended image or worse, catastrophic damage to the image processing apparatus.

Further, the vacuum imaging drum axially extending flat acts to impart a bending force to the ends of the dye donor materials when they are held onto the vacuum imaging drum surface by vacuum from within the interior of the vacuum imaging drum. Consequently when the vacuum is turned off to that portion of the vacuum imaging drum, the end of the dye donor material will tend to lift from the surface of the vacuum imaging drum. Thus turning off of the vacuum eliminates the bending force on the dye donor material, and is used as an advantage in the removal of the dye donor material from the vacuum imaging drum.

The task of loading and unloading the dye donor materials onto and off from the vacuum imaging drum, requires precise positioning of thermal print media and the dye donor materials. The lead edge positioning of dye donor material must be accurately controlled during this process. Existing image processing apparatus designs, such as that disclosed in the above commonly assigned U.S. patent, employs a multi-chambered vacuum imaging drum for such lead-edge control. One appropriately controlled chamber applies vacuum that holds the lead edge of the dye donor material. Another chamber, separately valved, controls vacuum that holds the trail edge of the thermal print media, to the vacuum imaging drum. With this arrangement, loading a sheet of thermal print media and dye donor material requires that the image processing apparatus feed the lead edge of the thermal print media and dye donor material into position just past the vacuum ports controlled by the respective valved chamber. Then vacuum is applied, gripping the lead edge of the dye donor material against the vacuum imaging drum surface.

Unloading the dye donor material or the thermal print media (to discard the used dye donor material or to deliver the finished thermal print media to an output tray) requires the removal of vacuum from these same chambers so that an edge of the thermal print media or the dye donor material are freed and project out from the surface of the vacuum imaging drum. The image processing apparatus then positions an articulating skive into the path of the free edge to lift the edge further and to feed the dye donor material, to a waste bin or an output tray.

The sheet material exit transports include a dye donor material waste exit and the imaged thermal print media sheet material exit. The dye donor material exit transport comprises a waste dye donor material stripper blade disposed adjacent the upper surface of the vacuum imaging drum. In an unload position, the stripper blade is in contact with the waste dye donor material on the vacuum imaging drum surface. When not in operation, the stripper blade is moved up and away from the surface of the vacuum imaging drum. A driven waste dye donor material transport belt is arranged horizontally to carry the waste dye donor material, which is removed by the stripper blade from the surface of the vacuum imaging drum to an exit formed in the exterior of the image processing apparatus. A waste bin for the waste dye donor material is separate from the image processing apparatus. The imaged thermal print media sheet material exit transport comprises a movable thermal print media sheet material stripper blade that is disposed adjacent to the upper surface of the vacuum imaging drum. In the unload position, the stripper blade is in contact with the imaged thermal print media on the vacuum imaging drum surface. In the inoperative position, it is moved up and away from the surface of the vacuum imaging drum. A driven thermal print media sheet material transport belt is arranged horizontally to carry the imaged thermal print media removed by the stripper blade from the surface of the vacuum imaging drum. It then delivers the imaged thermal print media with the intended image formed thereon to an exit tray in the exterior of the image processing apparatus.

Although the presently known and utilized image processing apparatus is satisfactory, it is not without drawbacks. Print-head focus and print-head angular adjustment require spring-loaded mechanisms to provide a loading force against adjustment screws. This spring-loaded adjustment requires multiple components, which complicates the tasks of assembly and repair. Springs themselves must be carefully sized and specified to provide the proper back-loading. Springs wear over time, with corresponding changes to force applied when compressed. The relatively large surface area of the spring can allow dirt and debris to be attracted and held within the spring, which cannot be readily cleaned. Also, springs are subject to vibration and exhibit resonance characteristics that may be objectionable under some conditions. Springs may also affect the behavior of a subsystem when subjected to electromagnetic interference (EMI).

Prior use of permanent magnets as bearings and coupling take advantage of magnetic forces to eliminate wear and lubrication requirements (for example, U.S. Pat. No. 4,473,259 to Goldowsky, and U.S. Pat. No. 5,729,066 to Soong, et al.)

The use of magnetic springs is shown in the following patents:

U.S. Pat. No. 5,017,819 to Patt, et al. discloses the use of linear spring force characteristics of magnets in any direction relative to an orthogonal coordinate system, with primary application to motor use. This patent concerns itself with methods for achieving a linear force constant for a long movement of the magnetic spring and for controlled oscillation (such as is needed with Stirling refrigeration motors).

U.S. Pat. No. 5,148,066 to Beale, et al. discloses the use of magnetic springs for applying centering bias on a piston in a linear generator or motor.

U.S. Pat. No. 5,038,063 to Graber, et al. discloses the use of a permanent magnet in combination with an electromagnet to form a magnetic spring.

U.S. Pat. No. 4,863,240 to Nakajima, et al. discloses the design of a magnetic spring to constrain an objective lens in a neutral position.

While these patents show the use of electromagnetic devices and permanent magnets to provide a force that acts as a spring, none of the patents cited above discloses or suggests substituting magnets where springs would otherwise be used to provide a back-loading force against an adjustment to effect precise print-head focus and angular adjustment.

SUMMARY OF THE INVENTION

Accordingly, an object of the present invention is to overcome the drawbacks described above by using permanent magnets in combination to provide a magnetic load for print-head focus and angular adjustment settings.

An advantage of the present invention is that it reduces the number of parts required to effect loading against the adjustment device.

A further advantage of the present invention is that it allows quick assembly and disassembly of the print-head, without requiring removal or replacement of springs or other attached components.

A further advantage of the present invention is that it allows the print-head to be built as a separable module that can be placed into position on a translation table without requiring tools or fixtures.

A further advantage of the present invention is that it provides a loading force that is not highly sensitive to resonant effects (such as those that might affect springs) in an image processing apparatus.

Also, the present invention eliminates a possible source for noise or electromagnetic interference by eliminating springs, while providing the same loading functions that the springs provide.

The present invention further allows a wide range of tolerances for magnet strength, provided that magnet dimensions are suitable for the application.

Briefly summarized, according to one aspect of the present invention, the invention resides in an imaging processing apparatus for receiving thermal print media and dye donor materials for processing an intended image onto the thermal print media. In the existing image processing apparatus discussed above, adjustment of print-head distance to vacuum imaging drum surface, which is required for focus, is currently effected using a spring-loaded mechanism. Similarly, rotation of the print-head cylinder, which is required for precise swath width adjustment, is also effected using a spring-loaded mechanism. This arrangement requires careful spring selection, handling, and procedure. By replacing springs with permanent magnets in combination, the same loading effect can be obtained with fewer parts and without the disadvantages of springs.

The present invention relates to an image processing apparatus for writing images to a thermal print media. The image processing apparatus comprises a vacuum imaging drum; a print-head having a plurality of light sources; a lead screw for moving the print-head in a first direction; a focus adjustment device for varying a focus of the print-head; a print-head angular adjustment device for varying a print-head angle of the print-head; an encasement for the print-head; and a movable translation table that supports the print-head in the encasement. The lead screw controls a linear motion of the table.

The encasement comprises a first magnet having a first magnetic flux field disposed along a first axis parallel to an axis of the print-head; and a second magnet having a second magnetic flux field disposed along a second axis parallel to an axis tangent to the print-head.

The translation table comprises a third magnet that is mounted to oppose a first pole of the first magnet so as to create a first repulsive force along the first axis and to provide a back loading for focus adjustment of the print-head, wherein a second pole of the first magnet provides an attractive force against the focus adjustment device; and a fourth magnet that is mounted to oppose a first pole of the second magnet so as to create a second repulsive force along the second axis and provide a back-loading for angular adjustment of the print-head. A second pole of the second magnet provides an attractive force against the print-head angular adjustment device mounted on the encasement.

The present invention also relates to a method of adjusting a position of a print-head of an image processing apparatus. The method comprises the steps of providing a holder on a print-head of an image processing apparatus; providing at least one magnetic member on the holder; and positioning at least one adjusting device relative to the at least one first magnetic member so as to create attractive and repulsive magnetic forces which adjust a position of the print-head.

The present invention also relates to an image processing apparatus which comprises a print-head; a holder which holds the print-head relative to an imaging drum, the holder comprising at least one magnetic member; and at least one adjustment device positioned relative to said at least one magnetic member to create magnetic forces which adjust a position of the print-head.

The present invention also relates to an image processing apparatus which comprises a print-head; a holder which holds the print-head relative to an imaging drum, the holder comprising at least one first magnetic member; a support member which supports the holder and the print-head, the support member comprising at least one second magnetic member; and at least one adjusting device which adjusts a position of the print-head. The holder is positioned relative to the support member and the at least one adjusting device to permit the at least one first magnetic member and the at least one second magnetic member to interact and create attractive and repulsive magnetic forces, with the magnetic forces adjusting a position of the print-head.

The present invention also relates to an adjustment assembly for a print-head which comprises a holder which is adapted to hold a print-head, the holder comprising at least one first magnetic member; a support member which is adapted to support said holder, said support member comprising at least one second magnetic member; and at least one adjustment device for adjusting a position of a print-head held by the holder. The at least one first magnetic member of the holder, the at least one second magnetic member of the support member, and the at least one adjusting device interact with each other to create magnetic forces when the holder is supported on the support member, with the magnetic forces adjusting a positioning of a print-head held by the holder.

The present invention also relates to an image processing apparatus which comprises a print-head; at least one magnetic member operationally associated with the print-head; and at least one adjustment device positioned relative to the at least one magnetic member to create magnetic forces which adjust a position of the print-head.

Although not described in detail, it would be obvious to someone skilled in the art that this invention could be used in other applications where spring-loading would otherwise be used. This invention could be extended to include imaging applications as well as other types of application that require a back-loading force against an adjustment mechanism.

DETAILED DESCRIPTION OF THE INVENTION

Figure 1:
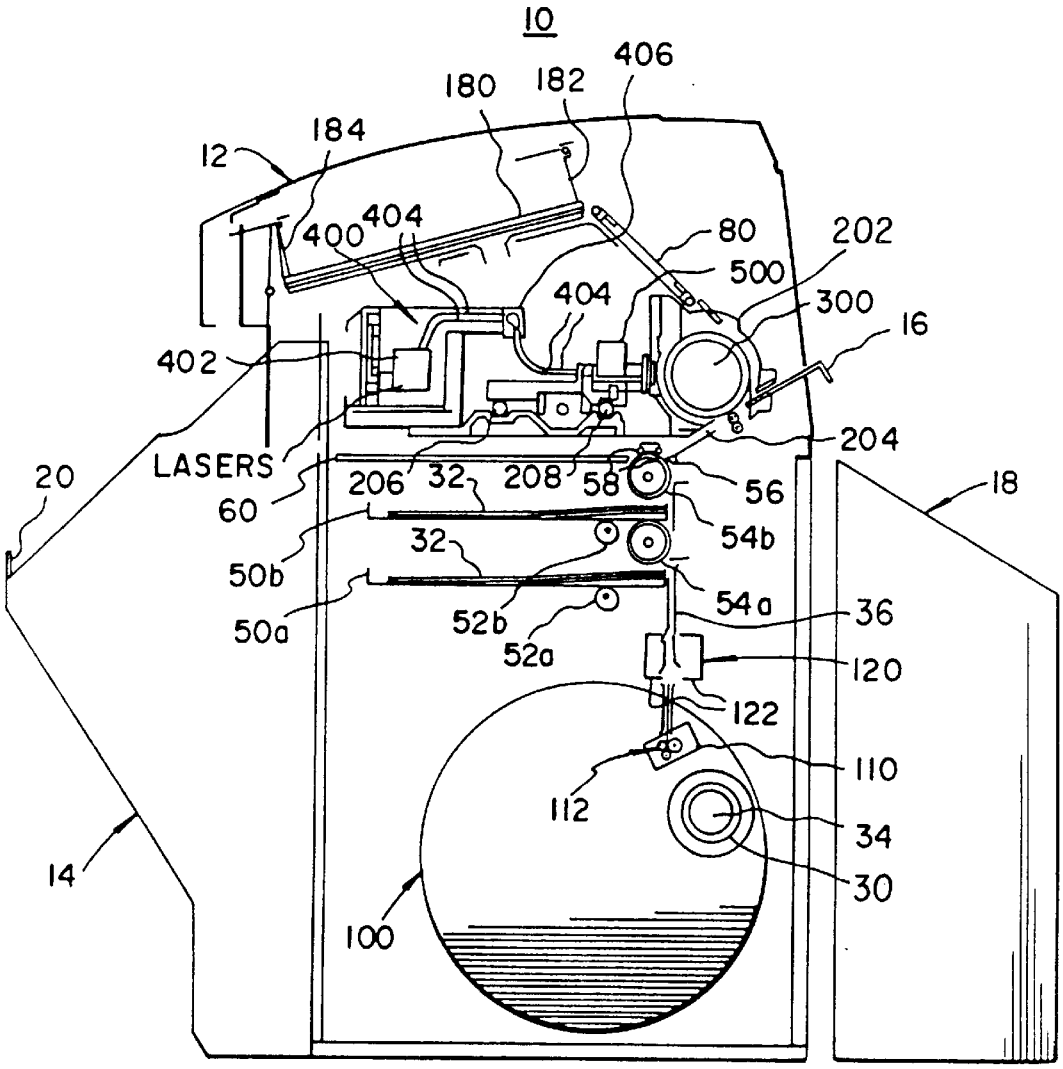
FIG. 1 is a side view in vertical cross section of an image processing apparatus of the present invention.

Referring now to the drawings, wherein like reference numerals designate identical or corresponding parts throughout the several views, FIG. 1 illustrates an image processing apparatus 10 according to the present invention. Image processing apparatus 10 includes an image processor housing 12 which provides a protective cover. A movable, hinged image processor door 14 is attached to a front portion of image processor housing 12 permitting access to two sheet material trays, a lower sheet material tray 50*a* and an upper sheet material tray 50*b*, that are positioned in an interior portion of image processor housing 12 for supporting thermal print media 32, thereon. Only one of sheet material trays 50*a*, 50*b* will dispense thermal print media 32 out of its sheet material tray to create an intended image thereon; the alternate sheet material tray 50*a*, 50*b* either holds an alternative type of thermal print media 32 or functions as a back up sheet material tray. In this regard, lower sheet material tray 50*a* includes a lower media lift cam 52*a* for lifting lower sheet material tray 50*a* and ultimately thermal print media 32, upwardly toward a rotatable, lower media roller 54*a* and toward a second rotatable, upper media roller 54*b* which, when both are rotated, permits thermal print media 32 in lower sheet material tray 50*a* to be pulled upwardly towards a movable media guide 56. Upper sheet material tray 50*b* includes an upper media lift cam 52*b* for lifting upper sheet material tray 50*b* and ultimately thermal print media 32 in upper sheet material tray 50*b* towards the upper media roller 54*b* which directs it towards movable media guide 56.

Movable media guide 56 directs thermal print media 32 under a pair of media guide rollers 58 which engages thermal print media 32 for assisting upper media roller 54*b* in directing it onto a media staging tray 60. Media guide 56 is attached and hinged to a lathe bed scanning frame 202 (FIG. 2) at one end, and is uninhibited at its other end for permitting multiple positioning of media guide 56. Media guide 56 then rotates its uninhibited end downwardly, as illustrated in the position shown in FIG. 1, and the direction of rotation of upper media roller 54*b* is reversed for moving thermal print media 32 resting on media staging tray 60 under the pair of media guide rollers 58, upwardly through an entrance passageway 204 and around a rotatable vacuum imaging drum 300.

A roll 30 of dye donor roll material 34 is connected to a media carousel 100 in a lower portion of image processor housing 12. Four rolls 30 of material 34 are used, but only one is shown for clarity. Each roll 30 includes a dye donor roll material 34 of a different color, typically black, yellow, magenta and cyan. These dye donor roll materials 34 are ultimately cut into dye donor sheet materials 36 and passed to the vacuum imaging drum 300 for forming the medium from which dyes imbedded therein are passed to thermal print media 32 resting thereon, which process is described in detail herein below. In this regard, a media drive mechanism 110 is attached to each roll 30 of dye donor roll material 34, and includes three media drive rollers 112 through which dye donor roll material 34 of interest is metered upwardly into a media knife assembly 120. After dye donor roll material 34 reaches a predetermined position, media drive rollers 112 cease driving dye donor roll material 34 and two media knife blades 122 positioned at a bottom portion of media knife assembly 120 cut dye donor roll material 34 into dye donor sheet materials 36. Lower media roller 54*a* and upper media roller 54*b* along with media guide 56 then pass dye donor sheet material 36 onto media staging tray 60 and ultimately to vacuum imaging drum 300 and in registration with thermal print media 32 using the same process as described above for passing thermal print media 32 onto vacuum imaging drum 300. Dye donor sheet material 36 now rests atop thermal print media 32 with a narrow space or gap between the two created by microbeads imbedded in the surface of thermal print media 32.

Figure 2:
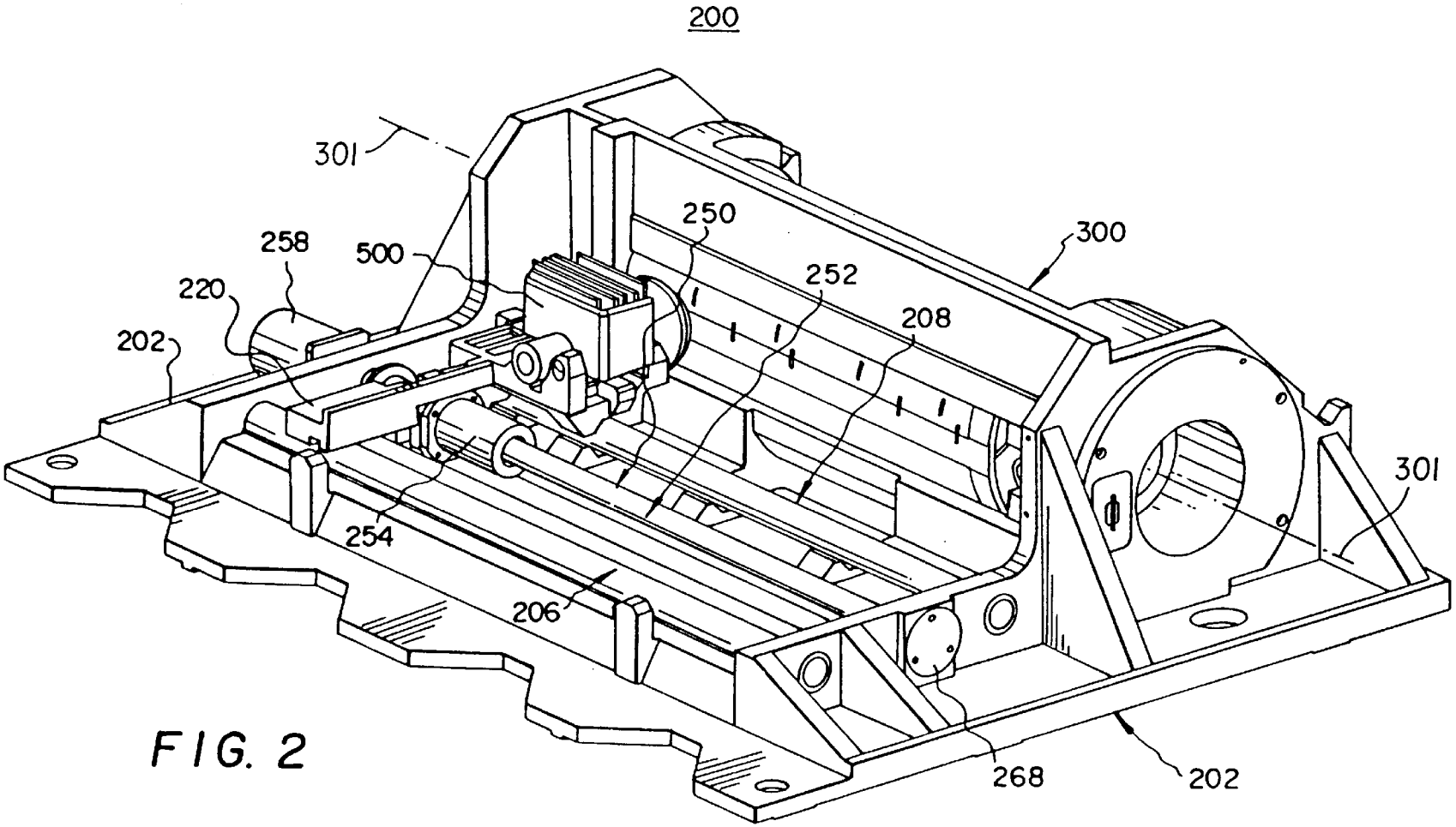
FIG. 2 is a perspective view of a lathe bed scanning subsystem or write engine of the present invention.

A laser assembly 400 includes a quantity of laser diodes 402 in its interior. Lasers diodes 402 are connected via fiber optic cables 404 to a distribution block 406 and ultimately to a print-head 500. Print-head 500 directs thermal energy received from laser diodes 402 causing dye donor sheet material 36 to pass the desired color across the gap to thermal print media 32. As shown in FIG. 2, print-head 500 is attached to a lead screw 250 via a lead screw drive nut 254 and a drive coupling (not shown) for permitting movement axially along the longitudinal axis of vacuum imaging drum 300. This permits a transferring of data to create an intended image on thermal print media 32. A linear drive motor 258 can be used to drive lead screw 250, while end cap 268 is mounted at the end of lead screw 250.

For writing, vacuum imaging drum 300 rotates at a constant velocity, and print-head 500 begins at one end of thermal print media 32 and traverse the entire length of thermal print media 32 for completing the transfer process for the particular dye donor sheet material 36 resting on thermal print media 32. After print-head 500 has completed the transfer process, for the particular dye donor sheet material 36 resting on thermal print media 32, dye donor sheet material 36 is then removed from vacuum imaging drum 300 and transferred out image processor housing 12 via a skive or ejection chute 16 (FIG. 1). As shown in FIG. 1, dye donor sheet material 36 eventually comes to rest in a waste bin 18 for removal by the user. The above described process is then repeated for the other three rolls 30 of dye donor roll materials 34.

After the color from all four rolls of dye donor materials 34 have been transferred and dye donor sheet materials 36 have been removed from vacuum imaging drum 300, thermal print media 32 is removed from vacuum imaging drum 300 and transported via a transport mechanism 80 to a dye binding assembly 180. An entrance door 182 of dye binding assembly 180 is opened for permitting thermal print media 32 to enter dye binding assembly 180, and shuts once the thermal print media 32 comes to rest in dye binding assembly 180. Dye binding assembly 180 processes thermal print media 32 for further binding the transferred colors on the thermal print media 32 and for sealing the microbeads thereon. After the color binding process has been completed, a media exit door 184 is opened and thermal print media 32 with the intended image thereon passes out of dye binding assembly 180 and image processor housing 12 and comes to rest against a media stop 20.

Referring again to FIG. 2, there is illustrated a perspective view of a lathe bed scanning subsystem 200 of image processing apparatus 10, including a vacuum imaging drum 300, print-head 500 and lead screw 250 assembled in lathe bed scanning frame 202. Vacuum imaging drum 300 is mounted for rotation about an axis 301 in lathe bed scanning frame 202. Print-head 500 is movable with respect to vacuum imaging drum 300, and is arranged to direct a beam of light to dye donor sheet material 36. The beam of light from print-head 500 for each laser diode 402 (not shown in FIG. 2) is modulated individually by modulated electronic signals from image processing apparatus 10, which are representative of the shape and color of the original image; so that the color on dye donor sheet material 36 is heated to cause volatilization only in those areas in which its presence is required on thermal print media 32 to reconstruct the shape and color of the original image.

Print-head 500 is mounted on a movable translation stage member 220 which, in turn, is supported for low friction slidable movement on translation bearing rods 206 and 208. Translation bearing rods 206 and 208 (rear and front) are sufficiently rigid so as not to sag or distort as is possible between their mounting points and are arranged as parallel as possible with an axis 301 of vacuum imaging drum 300. An axis of print-head 500 is perpendicular to axis 301 of vacuum imaging drum 300. Front translation bearing rod 208 locates translation stage member 220 in vertical and horizontal directions with respect to axis 301 of vacuum imaging drum 300. Rear translation bearing rod 206 locates translation stage member 220 only with respect to rotation of translation stage member 220 about front translation bearing rod 208, so that there is no over-constraint condition of translation stage member 220 which might cause it to bind, chatter, or otherwise impart undesirable vibration or jitters to print-head 500 during the generation of an intended image.

Figure 3:
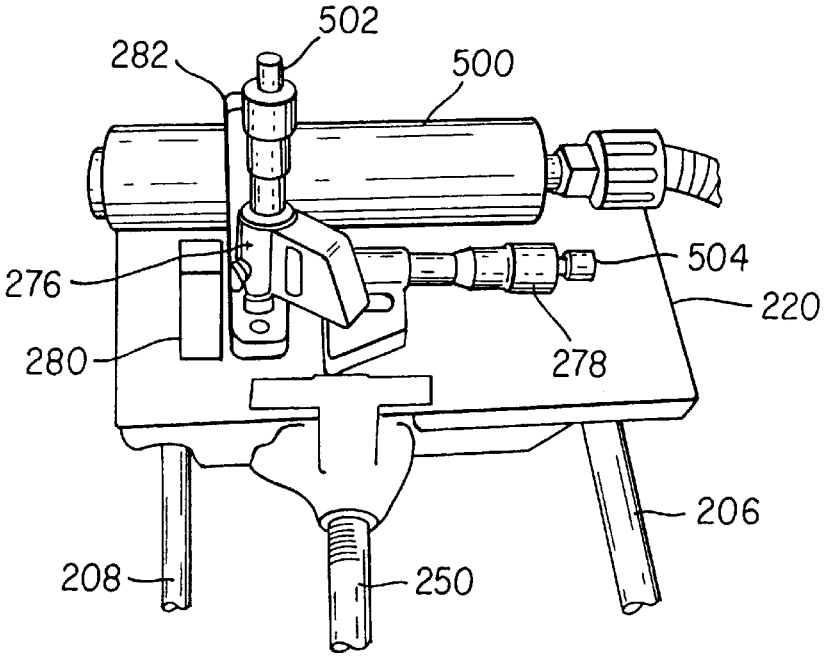
FIG. 3 shows a perspective view of a print-head mounting in a translation subsystem using this invention, from the right side (as oriented when facing into the lens)
Figure 4:
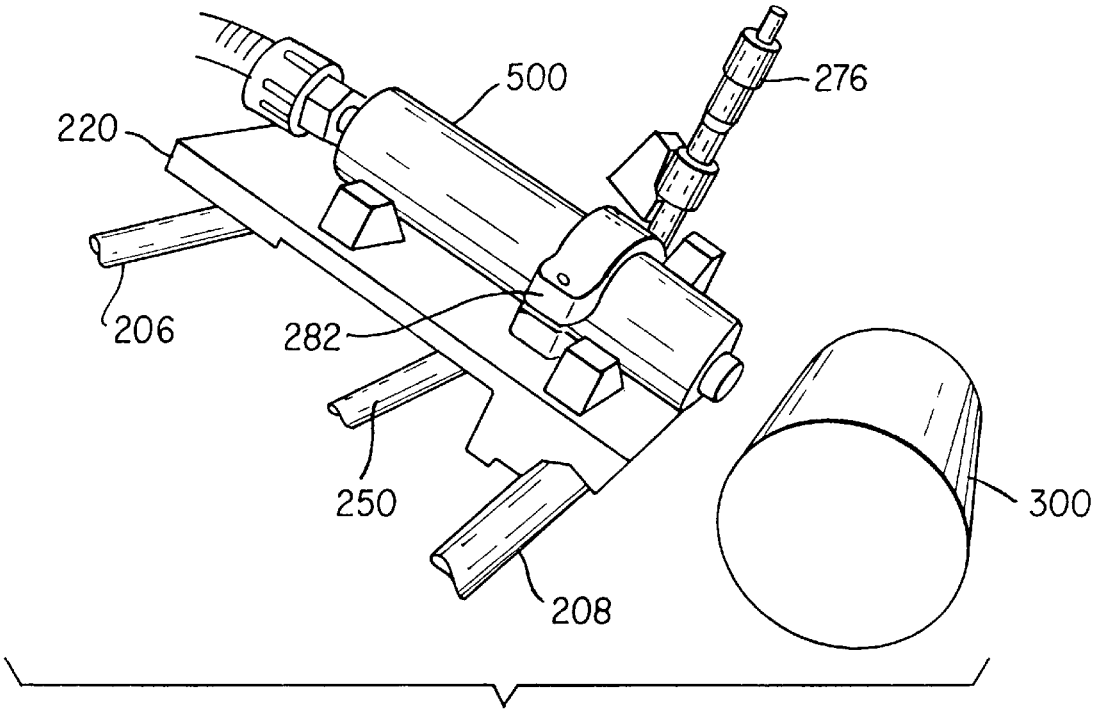
FIG. 4 shows a perspective view of the print-head mounting in the translation subsystem using this invention, from the left side (as oriented when facing into the lens)

FIG. 3 shows a perspective view of print-head 500 as mounted on translation stage member 220, viewed from the right side (as oriented when facing into the lens). FIG. 4 shows a perspective view of print-head 500 as mounted on translation stage member 220, viewed from the left side (as oriented when facing into the lens). These figures show the mechanisms that allow both the focus adjustment of print-head 500 and the rotational head angle adjustment of print-head 500. Focus adjustment 504 is performed using a focus micrometer 278, which is mounted flat against the surface of translation stage member 220 so that the axis of focus micrometer 278 is parallel to the axis of print-head 500. Head angle adjustment 502 is performed using a head angle micrometer 276. Each of the adjustment devices can be in the form of a set screw or similar device.

Digital micrometers allow precise adjustment of the angle of focus of print-head 500 during final assembly and during troubleshooting. For accurate adjustment permanent magnets operationally associated with print-head 500 are utilized. Permanent magnets in repulsion are used to apply a load against the micrometer. The repulsion force that results when these permanent magnets are placed with similar poles in proximity to each other creates a magnetic "spring-loading" effect against the micrometer. This invention uses both magnetic repulsion for the loading force and magnetic attraction for the holding force against each digital micrometer. Both head angle micrometer 276 and focus micrometer 278 are machined to have a rounded tip so as to provide a single point of contact against the loading force.

Figure 5A:
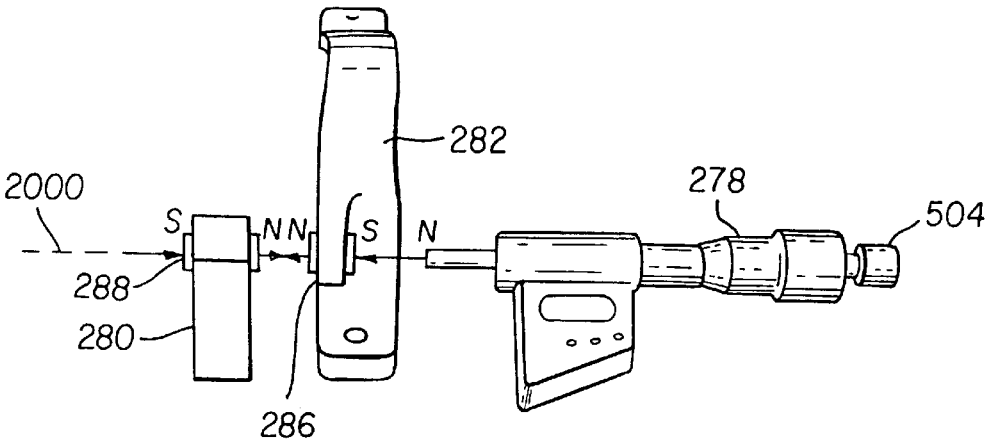
FIG. 5*a* is an exploded view showing the magnetic forces used to effect focus adjustment.
Figure 5B:
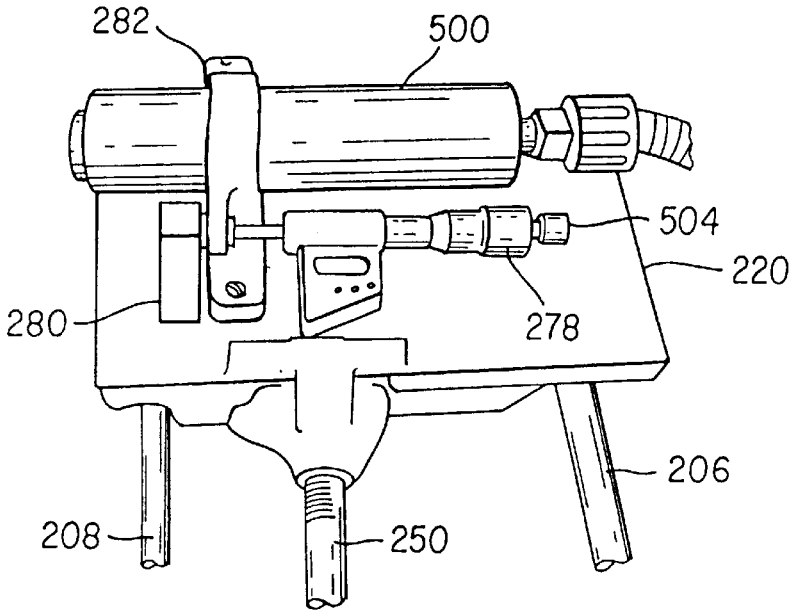
FIG. 5*b* is a perspective view showing only those components used for focus adjustment.

The exploded view of FIG. 5*a* shows the magnetic forces which create magnetic flux fields and are employed for focus positioning of print-head 500. The assembly view of FIG. 5*b* shows how these components are arranged on translation stage member 220. Print-head 500 is mounted within an adjustment collar or holder 282. Adjustment collar 282 holds a collar focus magnet 286, with its poles positioned axially with respect to focus micrometer 278. The pole of collar focus magnet 286 that faces a forward mounting block 280 is in repulsion with a forward mounting block magnet 288 positioned within forward mounting block 280. The other pole of collar focus magnet 286 is attracted to the shaft of focus micrometer 278, which is machined to have a rounded surface, to provide a single point of contact against the attracted collar focus magnet 286. The positioning of magnets 286 and 288 create a magnetic flux field along an axis 2000 which is parallel to an axis of printhead 500. As shown in FIG. 5*a*, the attraction and repulsion forces extend along axis 2000. Alternately, another magnet could be fastened, using epoxy or other means, to the shaft of focus micrometer 278 as a focus micrometer magnet. This arrangement of magnets and the resulting magnetic attraction creates a loading force against the focus micrometer 278.

Magnets used in the preferred embodiment of this invention are bonded Neodymium-iron-boron (NdFeB) alloys (although other types of permanent magnets or electromagnets could be used). Magnetic force can vary over a wide range, with the optimal magnet strength selected empirically.

For the image processing apparatus in the embodiment of this invention, the correct focus adjustment must be precise to within ±4 microns. To allow an adjustment with this sensitivity, adjustment collar 282 is first mounted and clamped into position on the body of print-head 500. A single screw (shown in FIG. 6*a*) fastens adjustment collar 282 securely to print-head 500. Then, print-head 500 is coarsely positioned on translation stage member 220. Focus micrometer 278 as described then provides the fine adjustment for focus distance. Print-head 500 is positioned within a V-groove 1000 (see FIG. 8) that keeps print-head 500 straight, with its focal axis orthogonal to vacuum imaging drum 300 surface when this adjustment is performed.

Magnetic hysteresis effects can cause the back-loading force resulting from the two opposed magnets to vary. The process for obtaining focus distance adjustment compensates for magnetic hysteresis as follows: first, identify an initial focus point, determined by generating a test image. Then, back print-head 500 away from this point a sufficient distance. Next, move the lens forward in small increments, almost back to the initial focus point. With each new adjustment, generate a test image and check focus using that image. By alternate adjustment and imaging in this fashion the focus adjustment of print-head 500 is completed iteratively. Optimal focus can be measured using criteria such as spot size and exposure.

Figure 6A:
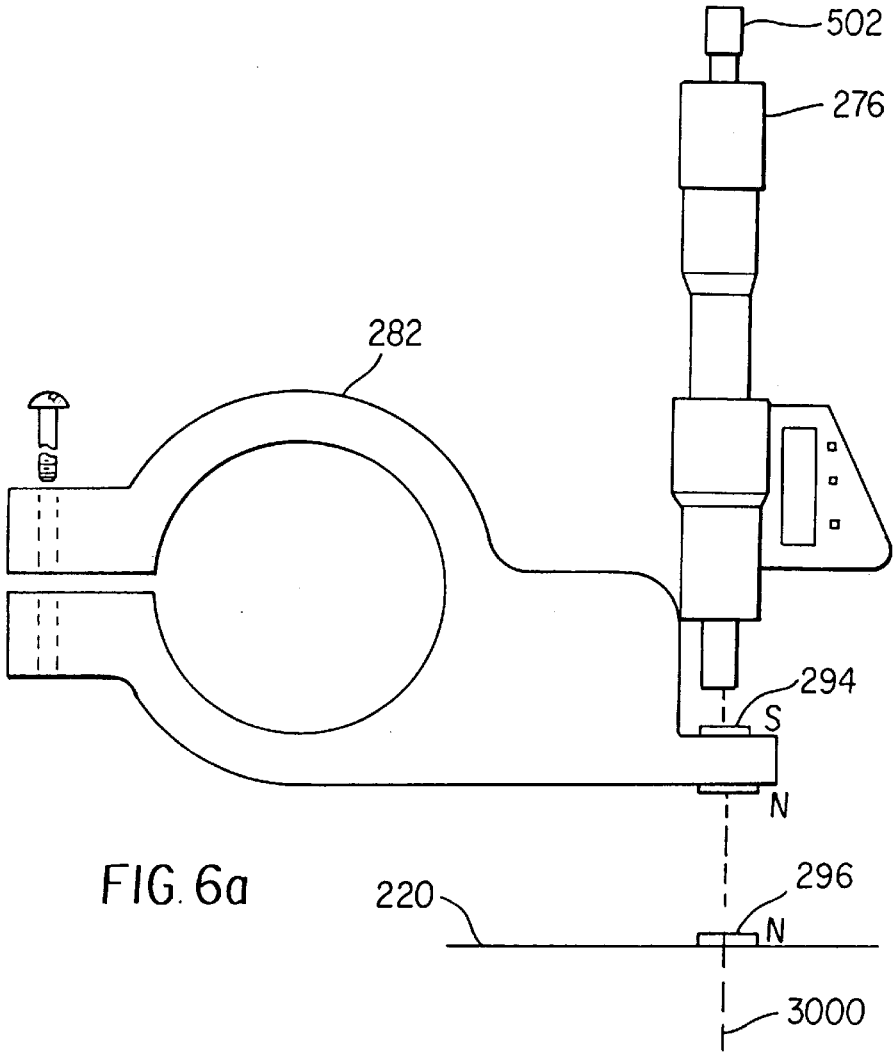
FIG. 6*a* is an exploded view showing the magnetic forces used to effect print-head rotational adjustment.
Figure 6B:
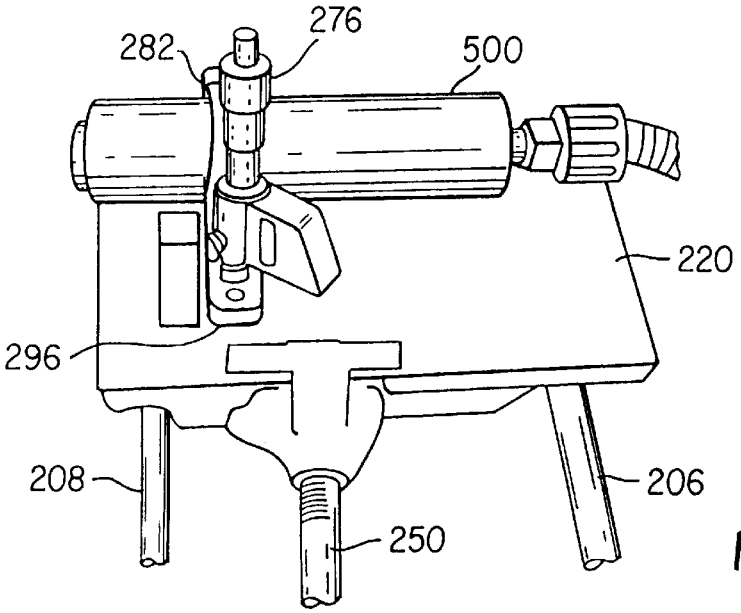
FIG. 6*b* is a perspective view showing only those components used for print-head rotational adjustment.

The exploded view of FIG. 6*a* shows the magnetic forces which create magnetic flux fields and are employed for head angle positioning of print-head 500. The assembly view of FIG. 6*b* shows, in perspective, how these components are arranged on translation stage member 220. Adjustment collar 282 holds a collar head angle magnet 294, with its poles positioned axially with respect to head angle micrometer 276. The pole of collar head angle magnet 294 that faces downward towards translation stage member 220 is in repulsion with a translation stage head angle magnet 296 mounted on translation stage member 220. The other pole of collar head angle magnet 294 is attracted to head angle micrometer 276. The positioning of magnets 294 and 296 create a magnetic flux field along an axis 3000 which is parallel to an axis which is tangent to printhead 500. As shown in FIG. 6*a*, the attraction and repulsion forces extend along axis 3000. Alternately, another magnet could be fastened, using epoxy or other means, to the shaft of head angle micrometer 276 as a head angle micrometer magnet. This arrangement of magnets and the resulting magnetic attraction creates a loading against head angle micrometer 276. Head angle micrometer 276 is fastened to a middle mounting block 284 (shown in FIG. 8) on translation stage member 220.

For the image processing apparatus in the embodiment of this invention, the correct head angle adjustment must be precise, so that the writing swaths align with approximately 1 pixel distance between adjacent writing swath edges. To allow adjustment with this sensitivity, print-head 500 is initially mounted in adjustment collar 282 with its laser channels oriented horizontally, relative to the flat base of the adjustment collar 282 which lies on the surface of translation stage member 220. An image is then generated and the swath-to-swath distance is carefully measured on the output image. The head angle is adjusted in increments, so that the desired swath-to-swath distance can be achieved. (Magnetic hysteresis compensation is similarly applied for angle adjustment measurement.)

Figure 7A:
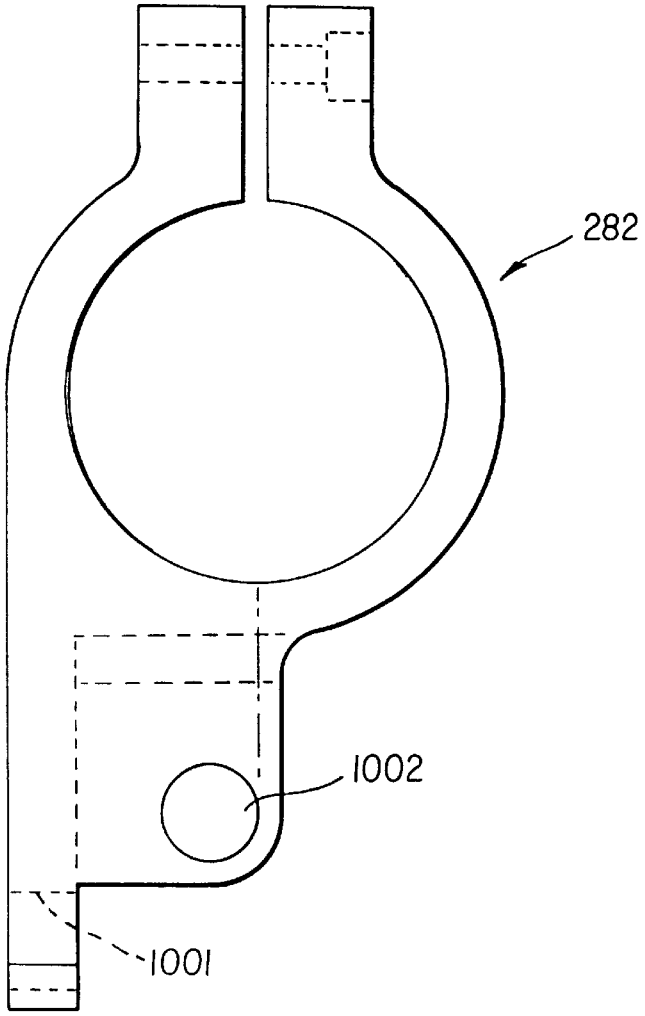
FIGS. 7*a* and 7*b* respectively show front and top views of a print-head adjustment collar.
Figure 7B:
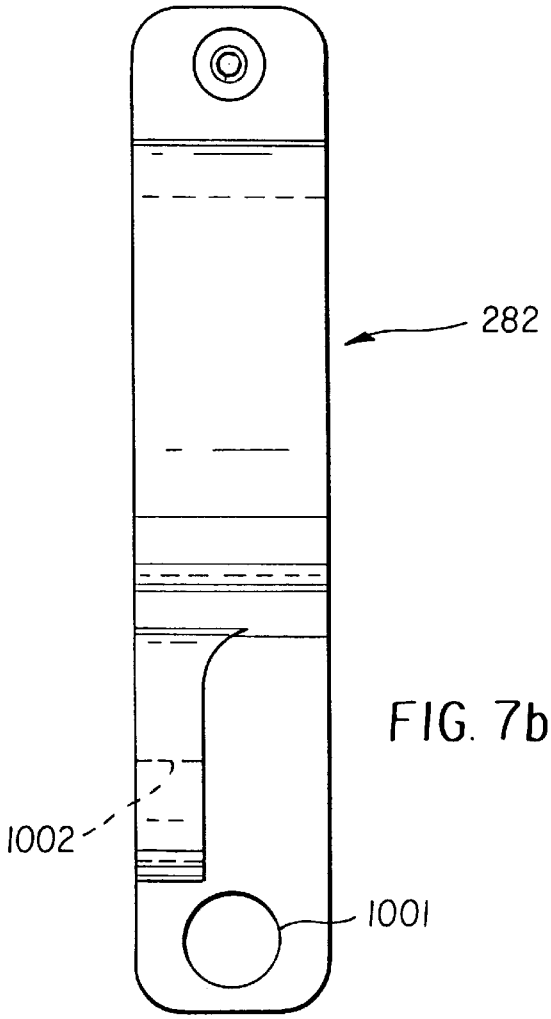

FIGS. 7*a* and 7*b* give flat front and top views of adjustment collar 282, respectively. Permanent magnets are inserted in openings 1001, 1002 provided. That is, collar focus magnet 286 is inserted in opening 1002 and collar head angle magnet 294 is inserted in opening 1001.

Figure 8:
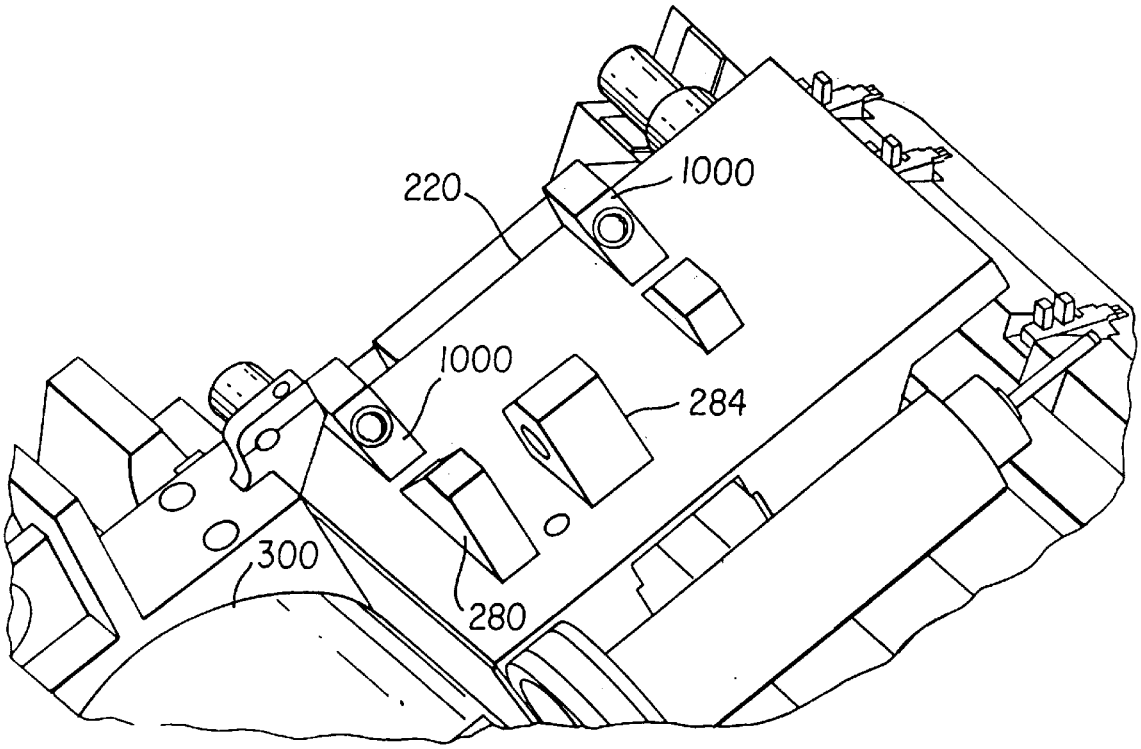
FIG. 8 shows an arrangement of mounting blocks on a translation stage member.

FIG. 8 shows the arrangement of mounting blocks on translation stage member 220, as it would be viewed with print-head 500 and the adjustment support circuitry removed.

With this invention, the magnets used are sized dimensionally to eliminate offset effects where, for example, the focus adjustment also shifts the relative positions of the magnets used for head angle adjustment. The arrangement of magnets described herein holds print-head 500 firmly in position, with orthogonal forces applied to adjustment collar 282.

Using the embodiment described above, print-head 500 is assembled by inserting the print-head 500 cylinder into the assembled adjustment collar 282. Adjustment collar 282 is then fastened to print-head 500 using a screw, as shown in FIG. 6*a*. Next, this combined assembly is placed in V-groove 1000 (FIG. 8) on translation stage member 220. Head angle micrometer 276 and focus micrometer 278 are fastened in place on translation stage member 220. Adjustment then proceeds in stages, first by adjusting print-head focus and head angle coarsely for a starting position. Then, a successive sequence of measurements and adjustments are needed to adjust both settings of print-head 500. Micrometers are used to enable very accurate relative changes from the current position.

The invention has been described with reference to the preferred embodiment thereof. However, it will be appreciated and understood that variations and modifications can be effected within the spirit and scope of the invention, as described herein above and as defined in the appended claims, by a person of ordinary skill in the art without departing from the scope of the invention. For example, the invention could be used to obtain only one of the two adjustments noted above. Or, this invention could be used for any precision adjustment where spring-loading against an adjustment device is necessary. This invention could be applied to other imaging applications and imaging technologies, such as for inkjet printers. This invention could also be applied as well as to non-imaging applications.

PARTS LIST

Parts List

10. Image processing apparatus
12. Image processor housing
14. Image processor door
16. Donor ejection chute
18. Donor waste bin
20. Media stop
30. Roll media
32. Thermal print media
34. Dye donor roll material
36. Dye donor sheet material
50*a*. Lower sheet material tray
50*b*. Upper sheet material tray
52*a*. Lower media lift cam
52*b*. Upper media lift cam
54*a*. Lower media roller
54*b*. Upper media roller
56. Media guide
58. Media guide rollers
60. Media staging tray

80. Transport mechanism
100. Media carousel
110. Media drive mechanism
112. Media drive rollers
120. Media knife assembly
122. Media knife blades
180. Dye binding assembly
182. Media entrance door
184. Media exit door
200. Lathe bed scanning subsystem
202. Lathe bed scanning frame
204. Entrance passageway
206. Rear translation bearing rod
208. Front translation bearing rod
220. Translation stage member
250. Lead screw
254. Lead screw drive nut
258. Linear drive motor
268 End cap
276. Head angle micrometer
278. Focus micrometer
280. Forward mounting block
282. Adjustment collar
284. Middle mounting block
286. Collar focus magnet
288. Forward mounting block magnet
294. Collar head angle magnet
296. Translation stage member head angle magnet
300. Vacuum imaging drum
301. Axis of rotation
400. Laser assembly
402. Laser diodes
404. Fiber optic cables
406. Distribution block
500. Print-head
502. Head angle adjustment
504. Focus adjustment
1000 V-groove
1001 Opening
1002 Opening
2000 Axis
3000 Axis

What is claimed is:

1. An image processing apparatus for writing images to a thermal print media, the image processing apparatus comprising:

a vacuum imaging drum;

a print-head having a plurality of light sources;

a lead screw for moving said print-head in a first direction;

a focus adjustment device for varying a focus of said print-head;

a print-head angular adjustment device for varying a print-head angle of said print-head;

an encasement for said print-head; and a movable translation table that supports said print-head in said encasement, said lead screw controlling a linear motion of said table;

said encasement comprising:

a first magnet having a first magnetic flux field disposed along a first axis parallel to an axis of said print-head; and a second magnet having a second magnetic flux field disposed along a second axis parallel to an axis tangent to said print-head;

said translation table comprising:

a third magnet that is mounted to oppose a first pole of said first magnet so as to create a first repulsive force along said first axis and to provide a back loading for focus adjustment of said print-head, wherein a second pole of said first magnet provides an attractive force against said focus adjustment device; and a fourth magnet that is mounted to oppose a first pole of said second magnet so as to create a second repulsive force along said second axis and provide a back-loading for angular adjustment of said print-head, wherein a second pole of said second magnet provides an attractive force against said print-head angular adjustment device mounted on said encasement.

2. An image processing apparatus according to claim 1, wherein:

said focus adjustment device comprises a first micrometer mounted on said translation table, such that an adjustment of said first micrometer is opposed by a first loading force provided by said first repulsive force; and said print-head angular adjustment device comprises a second micrometer mounted on said translation table, such that an adjustment of said second micrometer is opposed by a second loading force provided by said second repulsive force.

3. An image processing apparatus according to claim 1, wherein at least one of said focus adjustment device and said print-head angular adjustment device is a set screw.

4. An image processing apparatus according to claim 1, wherein at least one of said first, second, third and fourth magnets is an electromagnet.

5. An image processing apparatus according to claim 1, wherein an end of said focus adjustment device which faces said second pole of said first magnet is magnetized to increase said attractive force against said focus adjustment device.

6. A method of adjusting a position of a print-head of an image processing apparatus, the method comprising the steps of:

providing a holder on a print-head of an image processing apparatus;

providing at least one magnetic member on said holder;

positioning at least one adjusting device relative to said at least one magnetic member so as to create magnetic forces which adjust a position of the print-head;

wherein said magnetic forces adjust a focus of said print-head; and wherein said magnetic forces vary a head angle of said print-head.

7. An image processing apparatus comprising:

a print-head;

a holder which holds said print-head relative to an imaging drum, said holder comprising at least one magnetic member;

at least one adjustment device positioned relative to said at least one magnetic member to create magnetic forces which adjust a position of said print-head;

wherein said at least one adjustment device adjusts a focus of said print-head; and wherein said at least one adjustment device varies a head angle of said print-head.

8. An image processing apparatus comprising:

a print-head;

a holder which holds said print-head relative to an imaging drum, said holder comprising at least one first magnetic member;

a support member which supports said holder and said print-head, said support member comprising at least one second magnetic member;

at least one adjusting device which adjusts a position of said print-head;

wherein said holder is positioned relative to said support member sand said at least one adjusting device to permit said at least one first magnetic member and said at least one second magnetic member to interact and create attractive and repulsive magnetic forces, said magnet forces adjusting a position of said print-head;

wherein said at least one adjustment device adjusts a focus of said print-head; and wherein said at least one adjustment device varies a head angle of said print-head.

9. An adjustment assembly for a print-head comprising:

a holder which is adapted to hold a print-head, said holder comprising at least one first magnetic member;

a support member which is adapted to support said holder, said support member comprising at least one second magnetic member;

at least one adjustment device for adjusting a position of a print-head held by said holder;

wherein said at least one first magnetic member of said holder, said at least one second magnetic member of said support member, and said at least one adjusting device interact with each other to create magnetic forces when said holder is supported on said support member, said magnetic forces adjusting a positioning of a print-head held by said holder;

wherein said at least one adjustment device adjusts a focus of said print-head; and wherein said at least one adjustment device varies a head angle of the print-head.

* * * * *